United States Patent [19]

Finn et al.

[11] Patent Number: 4,485,165

[45] Date of Patent: Nov. 27, 1984

[54] PHOTOGRAPHIC ELEMENTS AND PROCESSES FOR PROVIDING A MONOCHROMATIC DYE IMAGE

[75] Inventors: Robert G. Finn; Charles D. DeBoer, both of Rochester, N.Y.

[73] Assignee: Eastman Kodak Company, Rochester, N.Y.

[21] Appl. No.: 580,400

[22] Filed: Feb. 15, 1984

[51] Int. Cl.[3] ..... G03C 5/54; G03C 1/90; G03C 1/40

[52] U.S. Cl. ..... 430/223; 430/212; 430/256; 430/259

[58] Field of Search ..... 430/212, 223, 256, 259

[56] References Cited

U.S. PATENT DOCUMENTS

| | | | |
|---|---|---|---|
| 3,087,817 | 4/1963 | Rogers | 430/223 |
| 3,227,551 | 1/1966 | Barr et al. | 430/226 |
| 3,617,275 | 11/1971 | Bloom et al. | 430/223 |
| 3,658,524 | 4/1972 | Piesach | 430/212 |
| 4,052,214 | 10/1977 | Oishi et al. | 430/212 |
| 4,076,529 | 2/1978 | Fleckenstein et al. | 430/223 |
| 4,377,632 | 3/1983 | Pflingston | 430/218 |

FOREIGN PATENT DOCUMENTS 2007378A 5/1979 United Kingdom .

OTHER PUBLICATIONS

Research Disclosure, vol. 181, Item 18157, May 1979.

*Primary Examiner*—Richard L. Schilling
*Attorney, Agent, or Firm*—Harold E. Cole

[57] ABSTRACT

Photographic elements, assemblages and processes are described for producing a monochromatic dye image. The assemblage comprises:

(a) a photosensitive element comprising a support having thereon a layer of nondiffusible dye image-providing material, a stripping layer, an opaque layer and a silver halide emulsion layer;

(b) a transparent cover sheet; and (c) opaque processing composition for application between the element and cover sheet. A dye mordant layer may also be present on the element or cover sheet.

After exposure and processing, the layer of nondiffusible dye image-providing material on a support is stripped away to provide a monochromatic retained dye image without the need for bleaching and fixing.

23 Claims, No Drawings

PHOTOGRAPHIC ELEMENTS AND PROCESSES FOR PROVIDING A MONOCHROMATIC DYE IMAGE

This invention relates to photography, and more particularly to color diffusion transfer photography for obtaining a monochromatic dye image. After exposure and processing of a photographic assemblage, a layer of nondiffusible dye image-providing material on a support is stripped from the remainder of the assemblage to provide a nonchromatic retained dye image. Good image discrimination is obtained without the need for bleaching and fixing.

U.S. Pat. No. 4,377,632 relates to obtaining a monochromatic dye image wherein a diffusible dye developer is employed. A dye developer layer, which is located on a support outside of the exposure path, is laminated to an assemblage after exposure. Upon processing, the dye developer than diffuses to an image-receiving layer which is then stripped from the remainder of the assemblage to provide a monochromatic dye image.

U.S. Pat. No. 3,617,275 also relates to a system for obtaining a monochromatic dye image. A preregistered film unit is employed with: (1) a silver halide layer on one support, (2) an image-receiving layer and color-providing material layer on a second support and (3) processing composition for application therebetween. After exposure and processing, the dye mordant layer is stripped away from the remainder of the assemblage to provide the monochromatic dye image.

U.S. Pat. No. 3,658,524 also relates to a preassembled film unit for obtaining a monochromatic dye image. In this film unit, the dye mordant layer and silver halide layer containing a nondiffusible dye image providing material are provided on the the same support. A spreader sheet is employed to facilitate distribution of processing compositions into the film unit. After exposure and processing, the image-receiving layer is stripped from the remainder of the film unit to provide the monochromatic dye image.

A problem exists in connection with the monochromatic dye images described in the prior art above, in that sharpness is always lost whenever the dye image has to diffuse through several layers to an image-receiving layer. This is especially objectionable in situations where the image is magnified several times.

An alternative approach for obtaining a monochromatic dye image is to remove unwanted dye by solubilizing it and transferring it into solution or to a mordant. The residual or retained dye image is then used as the desired image. However, such retained image systems invariably have silver halide within or in a layer adjacent to the imaging dye material. If optimum quality and low background density ($D_{min}$) are to be obtained, then bleaching and fixing of the silver halide are required. Such procedures are described, for example, in U.S. Pat. Nos. 3,087,817 (col. 19), 3,227,551 (col. 10), 4,052,214 (col. 4) and 4,076,529 (col. 3). Although this technology is well known and has been shown to be effective, separate bleaching and fixing steps, involving application of solutions, are required. This in turn may necessitate a separate drying step. These additional steps detract from the main advantages of diffusion transfer systems.

Another approach has been to employ the use of a bleach-fix cover sheet such as described in *Research Disclosure* 18157. However, this involves a complex timed release of chemicals from a highly loaded layer.

In U.K. patent application No. 2,007,378A, a process is described which does not involve diffusion of dyes in the photographic material, but wherein a final dye image is obtained. An imagewise distribution of an "image substance modifying/silver halide developing compound," such as a bleach developer, diffuses to a layer containing a "modifiable image substance," such as a bleachable dye, to form the dye image. In embodiments where a stripping layer is employed, aqueous processing baths are used to apply the bleach developer, so that the normal advantages of diffusion transfer processing are not obtained. In embodiments where a pod of processing composition containing the bleach developer is employed, a stripping layer is not described to enable one to obtain only the final dye image on a support. In summary, this reference does not disclose the use of a nondiffusible dye image-providing material which is capable of forming or releasing a diffusible dye, or the use of a stripping layer, or the use of opaque alkaline processing composition in the assemblages described hereinafter to produce a monochromatic dye image of superior sharpness.

Any system where chemical removal of silver is necessary takes time and is costly. Obtaining a monochromatic dye image without bleaching and fixing steps is highly desirable. These and other advantages are obtained in accordance with this invention.

A photographic assemblage in accordance with the invention comprises:

(a) a photosensitive element comprising a support having thereon the following layers in sequence: a layer comprising at least one nondiffusible dye image-providing material which is capable of forming or releasing a diffusible dye, a stripping layer, a substantially opaque layer and a photosensitive silver halide emulsion layer;

(b) a transparent cover sheet superposed over the silver halide emulsion layer; and (c) an opaque alkaline processing composition and means containing same for discharge, during processing, between the cover sheet and the photosensitive element.

In a preferred embodiment of the invention, the cover sheet or the photosensitive element has thereon a dye mordant layer to immobilize released dye and thereby facilitate diffusion of released dye from the layer containing the dye image-providing material.

The photographic assemblage described above may be preassembled prior to exposure and processing or may be assembled after exposure and during processing.

A process for producing a monochromatic dye image in accordance with the invention comprises exposing the photosensitive element described above, treating it with an alkaline processing composition in the presence of a silver halide developing agent to effect development of the exposed silver halide emulsion layer, whereby:

(a) an imagewise distribution of diffusible dye is formed as a function of development of the silver halide emulsion layer; and (b) substantially all of the imagewise distribution of diffusible dye diffuses out of the layer of the element in which it is initially contained, such as to another layer, into the processing solution, or to a dye mordant layer;

and then separating the dye image-providing material layer remaining on the support, by means of the stripping layer, from the remainder of the assemblage to provide the monochromatic dye image.

The photographic element in the above-described process can be treated with an alkaline processing composition to effect or initiate development in any manner. A preferred method for applying processing composition is by use of a rupturable container or pod which contains the composition.

The support for the photosensitive element described above may be either opaque for obtaining a reflection print or clear or semitranslucent for obtaining a transparency. If transparencies are obtained, they may be viewed through the support side or the opposite side depending upon the "viewing" required.

When a dye mordant layer is employed, it may be coated directly over the photosensitive element or on the cover sheet.

The type of emulsion and dye image-providing material employed determine whether the system is negative- or positive-working. The emulsion employed is usually panchromatically sensitized. If a negative emulsion is used with negative-working chemistry, the retained image of an exposure of a document with black or colored lines on a white background would yield a positive image. Conversely, a negative image of white lines on a colored background would be obtained using a direct-positive emulsion with the same negative-working chemistry. Positive-working redox dye releasers may also be employed in the invention. In a preferred embodiment of the invention, the silver halide emulsion is panchromatically sensitized and negative working.

One or more dye image-providing materials may be employed in the dye image-providing material layer described above to provide a maximum density ($D_{max}$) of the desired hue. Thus, a magenta dye image-providing material and a cyan dye image-providing material would provide a blue $D_{max}$ image. A neutral would be obtained by providing a balance of yellow, cyan and magenta dyes. Because the dye image is based on retained dye, there should be fewer problems with hue mismatches in $D_{max}$ regions based on dye diffusion rate differences. Because the $D_{max}$ obtained is determined by the level of dye coated, not the amount of dye transferred, better control over $D_{max}$ is possible.

In addition, access time should be more rapid than with other formats, since it is based on dye leaving the dye image-providing material layer, rather than dye migrating a distance to a dye mordant layer. As noted above, a sharp image is obtained in accordance with the invention because the image is formed by non-diffused dye. The image dye does not need to transfer through multiple layers or a thick processing fluid.

Any material may be employed as the stripping layer in the invention provided it will perform the desired function of stripping cleanly. Such materials are disclosed, for example, in U.S. Pat. Nos. 3,220,835, 3,730,718 and 3,820,999 and include gum arabic, sodium alginate, pectin, polyvinyl alcohol and hydroxyethyl cellulose. In a preferred embodiment of this invention, hydroxyethyl cellulose is employed as the stripping layer.

The stripping layer materials employed in this invention can be employed in any amount which is effective for the intended purpose. In general, good results have been obtained at a concentration of from about 5 to about 2000 mg/m$^2$ of element. The particular amount to be employed will vary, of course, depending on the particular stripping layer material employed and the nature of the other layers of the diffusion transfer element.

In a preferred embodiment of the invention, the means containing the alkaline processing composition is a rupturable container or pod which is adapted to be positioned during processing of the assemblage so that a compressive force applied to the container by pressure-applying members, such as would be found in a camera designed for in-camera processing, will effect a discharge of the container's contents within the assemblage. In general, the processing composition employed in this invention contains the developing agent for development, although the composition could also just be an alkaline solution where the developer is incorporated in the photosensitive element or cover sheet, in which case the alkaline solution serves to activate the incorporated developer.

The dye image-providing material useful in this invention is either positive- or negative-working, provided it is initially immobile in the photosensitive element during processing with an alkaline composition and forms or releases a diffusible dye upon reaction with oxidized or unoxidized developing agent. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607.

In a preferred embodiment of this invention, the dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of the invention, RDR's such as those in the Fleckenstein et al patents referred to above are employed. Such compounds are ballasted sulfonamido compounds which are alkali-cleavable upon oxidation to release a diffusible dye from the nucleus and have the formula:

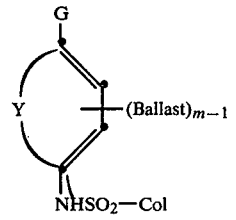

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is OR or $NHR^1$ wherein R is hydrogen or a hydrolyzable moiety and $R^1$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R^1$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazoline or pyrimidine; and (e) m is a positive integer or 1 to 2 and is 2 when G is OR or when $R^1$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529.

In another preferred embodiment of the invention, positive-working, nondiffusible RDR's of the type disclosed in U.S. Pat. Nos. 4,139,379 and 4,139,389 are employed. In this embodiment, an immobile compound is employed which as incorporated in a photosensitive element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

In general, the dye released from an RDR employed in this invention has the approximate hue of the RDR. If a dye precursor moiety is released from the RDR, however, it is shifted or converted to the desired hue during the processing step.

Generally speaking, except where noted otherwise, the silver halide emulsion layer employed in the invention comprises photosensitive silver halide dispersed in gelatin and is about 0.6 to 6 microns in thickness, and the dye image-providing material or materials are dispersed in an aqueous alkaline solution-permeable polymeric binder, such as gelatin, about 0.2 to 7 microns in thickness. Of course, these thicknesses are approximate only and can be modified according to the product desired.

Any material is useful as the mordant layer in certain embodiments of this invention, as long as the desired function of mordanting the dye images is obtained. A dye mordant layer would function to keep dye from wandering back into the layer containing the retained dye image. It would also act as a "sink" for dye to enhance the dye release reaction. The particular mordant material chosen will, of course, depend upon the dye to be mordanted. Suitable materials are disclosed on pages 80 through 82 of the November 1976 edition of *Research Disclosure,* the disclosure of which is hereby incorporated by reference.

A neutralizing layer may be employed in the assemblages of the invention in order to lower its pH after processing, thereby reducing any potential hazard to the user who comes in contact with the stripped portion of the assemblage which is to be discarded. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

In a preferred embodiment of the invention, the cover sheet of the assemblage has thereon, in sequence, a neutralizing layer, a timing layer and a dye mordant layer, as described above.

The opaque alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. The processing composition also contains an opacifying agent such as carbon black, titanium dioxide, mixtures of indicator dyes, etc. Suitable materials and addenda frequently added to such compositions are disclosed on pages 79 and 80 of the November, 1976 edition of *Research Disclosure,* the disclosure of which is hereby incorporated by reference.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

The supports for the photographic elements used in this invention can be may material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

The silver halide emulsion useful in this invention, either direct-positive or negative-working, is well known to those skilled in the art and is described in *Research Disclosure,* Volume 176, December, 1978, Item 17643, pages 22 and 23, "Emulsion preparation and types"; it is usually chemically and spectrally sensitized as described on page 23, "Chemical sensitization", and "Spectral sensitization and desensitization", of the above article; it is optionally protected against the production of fog and stabilized against loss of sensitivity during keeping by employing the materials described on pages 24 and 25, "Antifoggants and stabilizers", of the above article; it usually contains hardeners and coating aids as described on page 26, "Hardeners", and pages 26 and 27, "Coating aids", of the above article; it and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; it and other layers in the photographic elements used in this invention can contain addenda which are incorporated by using the procedures described on page 27, "Methods of addition", of the above article; and it is usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" is used herein is intended to mean that the materials can be in either the same or different layers, so long as the materials are accessible to one another.

The following examples are provided to further illustrate the invention.

EXAMPLE 1

A photosensitive element was prepared by coating the following layers on a transparent poly(ethylene terephthalate) film support. Coverages are parenthetically given in g/m$^2$ unless otherwise stated:

(1) RDR layer of Magenta RDR (0.70), cyan RDR (0.54) and gelatin (1.6);

(2) stripping layer of Natrosol® GXR-250 (Hercules) hydroxyethyl cellulose (0.43) and Fluorad® FC-431 (3M Company), polyethylene oxide perfluoroalkylated ester (0.04);

(3) opaque layer of carbon black (1.1) and gelatin (1.8); and (4) panchromatically sensitized silver bromide emulsion (1.3 mg Ag/m$^2$) and gelatin (1.1).

A bis(vinylsulfonyl)methane hardener was employed in layer 4 at 1.6% of total gelatin weight.

Magenta RDR

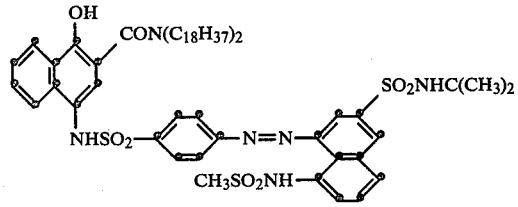

(Dispersed in diethyllauramide)
(RDR/solvent ratio 2:1)

Cyan RDR

-continued

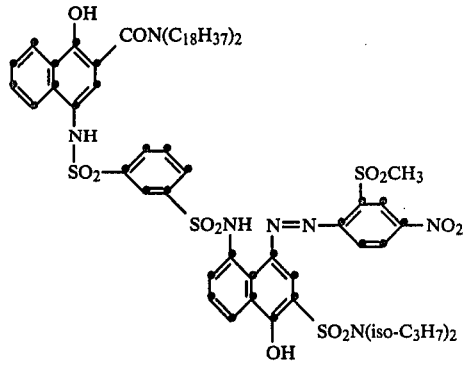

(Dispersed in N—n-butylacetanilide)
(RDR/solvent ratio 2:1)

A cover sheet consisting of a mordant poly(styrene-co-N-benzyl-N,N-dimethyl-N-vinylbenzylammonium chloride-co-divinylbenzene) (49:49:2 molar ratio) (2.0 g/m$^2$) in gelatin (2.0 g/m$^2$) was prepared.

A processing pod of the following composition was prepared:

| | |
|---|---|
| Potassium hydroxide | (52.2 g/l) |
| 4-Methyl-4-hydroxymethyl-1-p-tolyl-3-pyrazolidone | (12.0 g/l) |
| 5-Methylbenzotriazole | (4.0 g/l) |
| Carboxymethylcellulose | (46.0 g/l) |
| Potassium fluoride | (10.0 g/l) |
| Tamol SN ® dispersant | (6.4 g/l) |
| Potassium sulfite (anhydrous) | (1.0 g/l) |
| 1,4-Cyclohexanedimethanol | (1.5 g/l) |
| Carbon | (192.0 g/l) |
| Water to make a volume of | 1 liter |

The light-sensitive element was exposed in a sensitometer at 1/50 second (light intensity equal to an Eastman Ib Sensitometer), and then processed at room temperature (~21° C.) using a pod containing the processing composition described above. The processing composition was spread between the light-sensitive element and the mordant cover sheet using a pair of juxtaposed rollers to provide a fluid gap of 100 μm. After seven minutes, the laminated unit was separated at the point of the stripping layer. The Status A red and green transmission density of the retained image was:

| | |
|---|---|
| Red D-max = 1.9 | Red D-min = 0.16 |
| Green D-max = 2.0 | Green D-min = 0.26 |

EXAMPLE 2

An experiment similar to that of Example 1 was performed by placing the light-sensitive element in a camera, and exposing it for one second to an image on a visual display terminal of an IBM Personal Computer. The element was processed as in Example 1. Upon separation of the laminate after seven minutes processing, a good image of the screen letters in white (clear) on a blue background was obtained.

The invention has been described in detail with particular reference to preferred embodiments thereof, but it will be understood that variations and modifications can be effected within the spirit and scope of the invention.

What is claimed is:

1. A photographic assemblage comprising:
(a) a photosensitive element comprising a support having thereon the following layers in sequence: a layer comprising at least one nondiffusible dye image-providing material which is capable of forming or releasing a diffusible dye, a stripping layer, a substantially opaque layer and a photosensitive silver halide emulsion layer;
(b) a transparent cover sheet superposed over said silver halide emulsion layer; and
(c) an opaque alkaline processing composition and means containing same for discharge, during processing, between said cover sheet and said photosensitive element.

2. The assemblage of claim 1 wherein said cover sheet or said photosensitive element has thereon a dye mordant layer.

3. The assemblage of claim 1 wherein said support is transparent.

4. The assemblage of claim 1 wherein said nondiffusible dye image-providing material is a redox dye-releaser.

5. The assemblage of claim 1 wherein two nondiffusible dye image-providing materials are present comprising a magenta redox dye-releaser and a cyan redox dye-releaser.

6. The assemblage of claim 2 wherein said cover sheet has thereon, in sequence, a neutralizing layer, a timing layer and said dye mordant layer.

7. The assemblage of claim 1 wherein said silver halide emulsion is panchromatically sensitized and negative-working.

8. The assemblage of claim 1 wherein said nondiffusible dye image-providing material is a ballasted sulfonamido compound which is alkalicleavable upon oxidation to release a diffusible color-providing moiety, said compound having the formula:

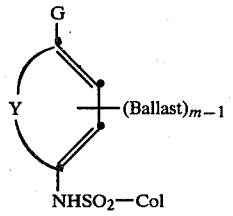

wherein:
(a) Col is a dye or dye precursor moiety;
(b) Ballast is an organic ballasting radical of such molecular size and configuration as to render said compound nondiffusible in said photosensitive element during development in said alkaline processing composition;
(c) G is OR or NHR$^1$ wherein R is hydrogen or a hydrolyzable moiety and R$^1$ is hydrogen or an alkyl group of 1 to 22 carbon atoms;
(d) Y represents the atoms necessary to complete a benzene nucleus, a naphthalene nucleus or a 5- to 7-membered heterocyclic ring; and
(e) m is a positive integer of 1 to 2 and is 2 when G is OR or when R$^1$ is hydrogen or an alkyl group of less than 8 carbon atoms.

9. The assemblage of claim 8 wherein
(a) said support is transparent,
(b) said cover sheet has thereon a dye mordant layer,
(c) two nondiffusible dye image-providing materials are present wherein one said Col is a magenta dye and another said Col is a cyan dye, and
(d) said silver halide emulsion is panchromatically sensitized and negative-working.

10. A photosensitive element comprising a support having thereon the following layers in sequence: a layer comprising at least one nondiffusible dye image-providing material which is capable of forming or releasing a diffusible dye, a stripping layer, a substantially opaque layer and a photosensitive silver halide emulsion layer.

11. The element of claim 10 wherein said support is transparent.

12. The element of claim 10 wherein said nondiffusible dye image-providing material is a redox dye-releaser.

13. The element of claim 10 wherein two nondiffusible dye image-providing materials are present comprising a magneta redox dye-releaser and a cyan redox dye-releaser.

14. The element of claim 10 wherein said silver halide emulsion is panchromatically sensitized and negative-working.

15. The element of claim 10 wherein said nondiffusible dye image-providing material is a ballasted sulfonamido compound which is alkalicleavable upon oxidation to release a diffusible color-providing moiety, said compound having the formula:

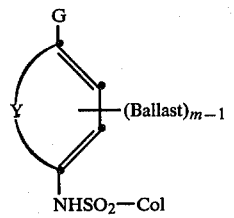

wherein:
(a) Col is a dye or dye precursor moiety;
(b) Ballast is an organic ballasting radical of such molecular size and configuration as to render said compound nondiffusible in said photosensitive element during development in an alkaline processing composition;
(c) G is OR or NHR$^1$ wherein R is hydrogen or a hydrolyzable moiety and R$^1$ is hydrogen or an alkyl group of 1 to 22 carbon atoms;
(d) Y represents the atoms necessary to complete a benzene nucleus, a naphthalene nucleus or a 5- to 7-membered heterocyclic ring; and
(e) m is a positive integer of 1 to 2 and is 2 when G is OR or when R$^1$ is hydrogen or an alkyl group of less than 8 carbon atoms.

16. The element of claim 15 wherein
(a) said support is transparent,
(b) two nondiffusible dye image-providing materials are present wherein one said Col is a magenta dye and another said Col is a cyan dye, and
(c) said silver halide emulsion is panchromatically sensitized and negative-working.

17. A process for producing a monochromatic dye image comprising:
(I) exposing a photosensitive element comprising a support having thereon the following layers in sequence: a layer comprising at least one nondiffusible dye image-providing material which is capable of forming or releasing a diffusible dye, a stripping layer, a substantially opaque layer and a photosensitive silver halide emulsion layer;

(II) treating said element with an alkaline processing composition in the presence of a silver halide developing agent to effect development of said exposed silver halide emulsion layer, whereby:

(a) an imagewise distribution of diffusible dye is formed as a function of said development of said silver halide emulsion layer; and (b) substantially all of said imagewise distribution of said diffusible dye diffuses out of the layer of said element in which it is initially contained; and (III) separating said dye image-providing material layer remaining on said support, by means of said stripping layer, from the rest of said assemblage to provide said monochromatic dye image.

18. The process of claim 17 wherein said support is transparent.

19. The process of claim 17 wherein said nondiffusible dye image-providing material is a redox dye-releaser.

20. The process of claim 17 wherein two nondiffusible dye image-providing materials are present comprising a magenta redox dye-releaser and a cyan redox dye-releaser.

21. The process of claim 17 wherein said silver halide emulsion is panchromatically sensitized and negative-working.

22. The process of claim 17 wherein said nondiffusible dye image-providing material is a ballasted sulfonamido compound which is alkalicleavable upon oxidation to release a diffusible color-providing moiety, said compound having the formula:

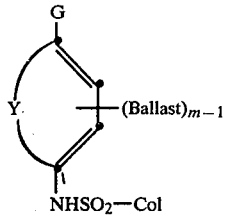

wherein:

(a) Col is a dye or dye precursor moiety;

(b) Ballast is an organic ballasting radical of such molecular size and configuration as to render said compound nondiffusible in said photosensitive element during development in said alkaline processing composition;

(a) G is OR or NHR$^1$ wherein R is hydrogen or a hydrolyzable moiety and R$^1$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) m is a positive integer of 1 to 2 and is 2 when G is OR or when R$^1$ is hydrogen or an alkyl group of less than 8 carbon atoms.

23. The process of claim 22 wherein (a) said support is transparent, (b) two nondiffusible dye image-providing materials are present wherein one said Col is a magenta dye and another said Col is a cyan dye, and (c) said silver halide emulsion is panchromatically sensitized and negative-working.

* * * * *